United States Patent [19]

Cocksedge

[11] Patent Number: 4,993,779

[45] Date of Patent: Feb. 19, 1991

[54] ELEMENT TO FORM A RACK FOR A MINING MACHINE HAULAGE SYSTEM

[75] Inventor: Richard Cocksedge, Doncaster, England

[73] Assignee: Pitcraft Summit Limited, Nr. Barnsley, United Kingdom

[21] Appl. No.: 502,128

[22] Filed: Mar. 29, 1990

[30] Foreign Application Priority Data

Jan. 10, 1990 [GB] United Kingdom ..... 9000582

[51] Int. Cl.[5] ..... F21C 29/04; F16G 13/14

[52] U.S. Cl. ..... 299/43; 59/85; 474/235

[58] Field of Search ..... 299/42, 43; 59/85, 90; 474/232, 235, 236; 105/29.1

[56] References Cited

U.S. PATENT DOCUMENTS

| | | | |
|---|---|---|---|
| 2,243,274 | 5/1941 | Ernst | 474/235 X |
| 4,372,619 | 2/1983 | Braun | 299/43 |
| 4,501,447 | 2/1985 | Tatton et al. | 299/43 |

*Primary Examiner*—Ramon S. Britts
*Assistant Examiner*—David J. Bagnell
*Attorney, Agent, or Firm*—R. A. Giangiorgi

[57] ABSTRACT

An element, adapted to be inter-engaged with a plurality of similar elements to form a rack for a mining machine haulage system, has each element comprising at one end, a looped end portion including inner and outer arcuate bearing surfaces, the inner bearing surface defining one end of an upwardly open aperture. A downwardly projecting tooth is spaced from the inner bearing surface and adapted to fill partly the aperture of the next adjacent inter-engaged element, while a correspondingly arcuate bearing surface is also provided on the tooth for abutment against the inner arcuate bearing surface of the adjacent element. Also, a transversely extending bridge is provided at the other end of the element, which bridge has transversely extending, and upwardly converging, planar faces for engagement, in use, by a tooth of a driven haulage system of an associated mining machine, dependent upon the direction of haulage. Finally, an arcuate concave bearing surface is also provided at opposite lateral sides of the element, for abutting engagement with the other arcuate bearing surface of the looped end portion of the next adjacent element.

5 Claims, 3 Drawing Sheets

ELEMENT TO FORM A RACK FOR A MINING MACHINE HAULAGE SYSTEM

BACKGROUND OF THE INVENTION

This invention relates to mine equipment and in particular to an element to form a rack, a rack made up from such elements and a haulage system for a mining machine which is adapted to traverse to and fro along a mineral face by engaging such a rack.

So-called "chainless" haulage systems have now been in operation, particularly in the course of coal mining, for several years, and various constructions of rack have been proposed, for engagement by the teeth of a drive or haulage device e.g. sprocket or a recirculating chain, all with differing advantages and disadvantages. Thus, one system uses a round link chain which is captivated by suitable furnishings attached to the associated conveyor, whereby should chain breakage occur, injury to personnel in the vicinity of the breakage is avoided. Clearly, chain loading limits are finite, and in mining conditions, with jamming the machine or its cutting head not infrequent, chain overload occurs and when breakage occurs, the chain, of several tons weight, must be pulled from its captivation furnishings, e.g. by being towed by a free-steer vehicle, and a fresh chain transported from an underground store or the surface, and inserted. During the whole of this time, no mineral production can occur. Also, the geometry is such that instead of, ideally, generating only horizontal haulage forces, upward forces are also generated providing no haulage effect and, on the contrary, tending to lift or separate the machine from the conveyor so that trapping slide shoes are required to resist this, but such shoes increase friction and wear. The trend of mining machine manufacturers is to build even more powerful machines producing even higher haulage forces.

SUMMARY OF THE INVENTION

According to a first aspect of the present invention, there is provided an element, adapted to be interengaged with a plurality of similar elements to form a rack for a mining machine haulage system, each element comprising, at one end, a looped end portion including inner and outer arcuate bearing surfaces, the inner bearing surface defining one end of an upwardly open aperture, and spaced from that inner bearing surface a downwardly projecting tooth adapted to fill partly the aperture of the next adjacent element, and having a correspondingly arcuate bearing surface for abutment against the inner arcuate bearing surface, and the other end of each element comprising a transversely extending bridge having transversely extending and upwardly converging planar faces for engagement, in use, by a tooth of a driven haulage system of an associated mining machine, dependent upon the direction of haulage, and an arcuately concave bearing surface also provided at opposite sides of each element, for abutting engagement with the outer arcuate bearing surface of the looped end portion of the next adjacent element.

According to a second aspect of the invention, there is provided a haulage rack for a mining machine assembled from a plurality of elements in accordance with the first aspect.

According to a third aspect of the invention, there is provided mine equipment in the form of a mining machine haulage system comprising an armoured face conveyor, a rack in accordance with the second aspect of the invention captivated to one side of the conveyor, a mining machine mounted on and/or guided by the conveyor and incorporating at least one haulage sprocket, the teeth of which are adapted to engage progressively the planar faces of successive bridges during haulage along the conveyor.

Thus, with the mine equipment in accordance with the invention, the rack is built up to the desired length, by interengaging an appropriate number of elements, with captivation furnishings then attached e.q. by bolts or by welding, to the conveyor, specifically to the individual the unit length line pans from which the conveyor of appropriate length e.g. 200 m, is built up. Consequently, installation is a relatively simple operation, whilst, should an element become worn or dam aged to the extent that it needs replacement, removal of the entire rack is unnecessary, as the relevant captivation furnishing(s) is simply unbolted, the worn or damaged element(s) removed and a fresh one(s) inserted, with the captivation furnishing(s) re-applied, and hence a minimum loss of production results. Furthermore, the disadvantageous generation of upward forces is diminished.

Clearly, a small amount of play is required between adjacent elements to ensure that the elements can be interengaged and disengaged with relative ease, but it will be appreciated that, dependent of the position of the haulage sprocket along the rack, the housings "downstream" will butt together in compression with the play disappearing, while those upstream will be in tension with play present, with buckling of the compressed section prevented by the captivation furnishings. This arrangement guarantees that correct pitch, and a positive line of drive is present at all times, whilst providing flexibility so as not to impede line pan movement during the conventional snaking of the conveyor, after passage of the mining machine, towards the newly exposed mineral face.

Furthermore, the inter-engaging elements are ideally each produced as steel forgings to accommodate extra heavy duty haulage forces e.g. 50 tons, compared with current systems capable of accommodating at most approximately half this loading.

The rack can be attached to either the face side or to the goaf side of the conveyor.

BRIEF DESCRIPTION OF THE DRAWINGS

The various aspect of the invention will now be described in greater detail, by way of example, with reference to the accompanying drawings, in which.

DESCRIPTION OF THE PREFERRED EMBODIMENTS

Figure 1:
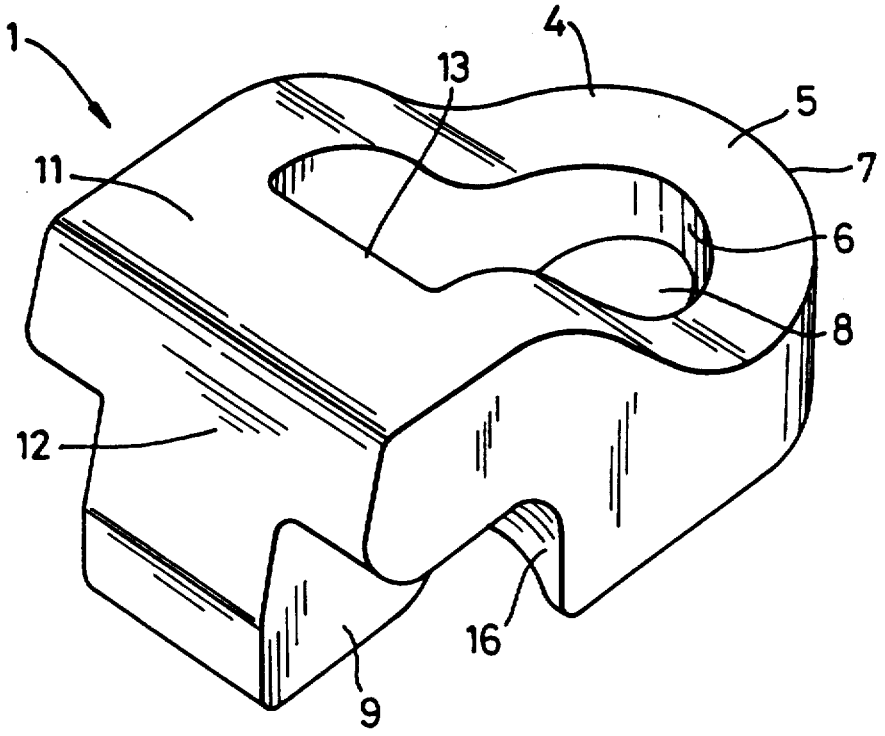
FIG. 1 is a perspective view of an element in accordance with the first aspect.
Figure 2:
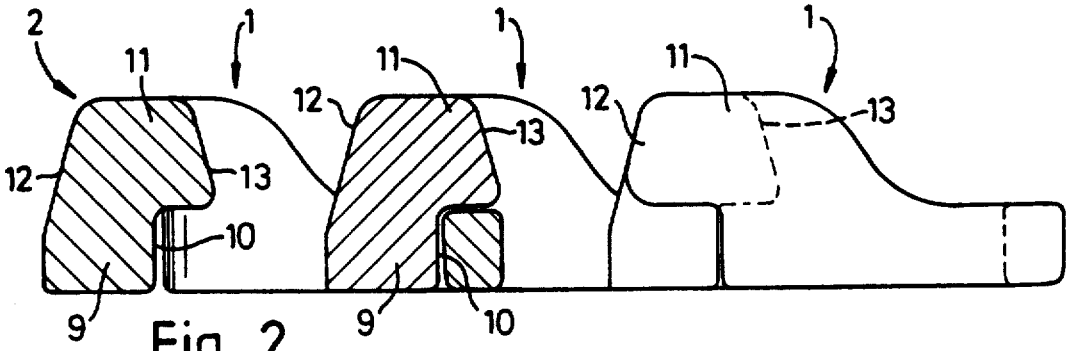
FIG. 2 is a front elevation, partly in section, of three elements of FIG. 1 inter-engaging to form part of a rack in accordance with the second aspect.
Figure 3:
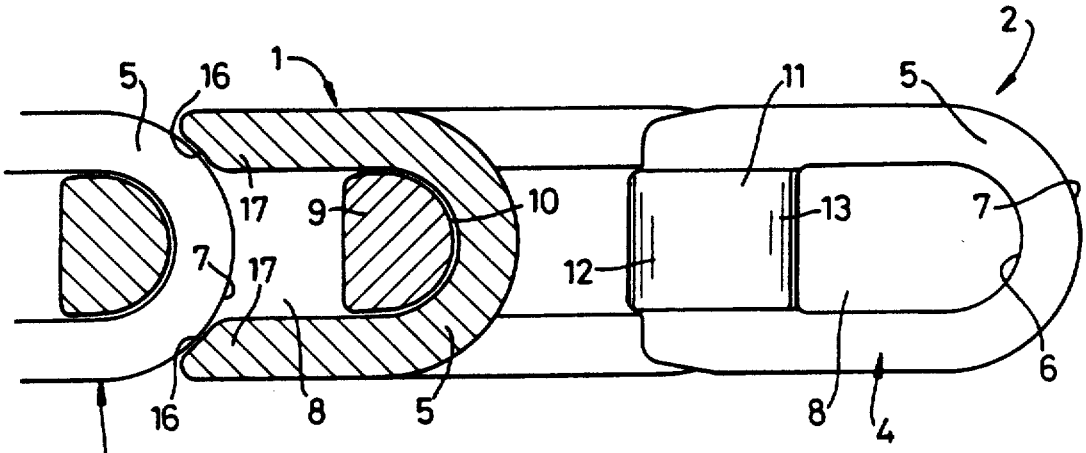
FIG. 3 is a plan view, partly in section of FIG. 2.
Figure 4:
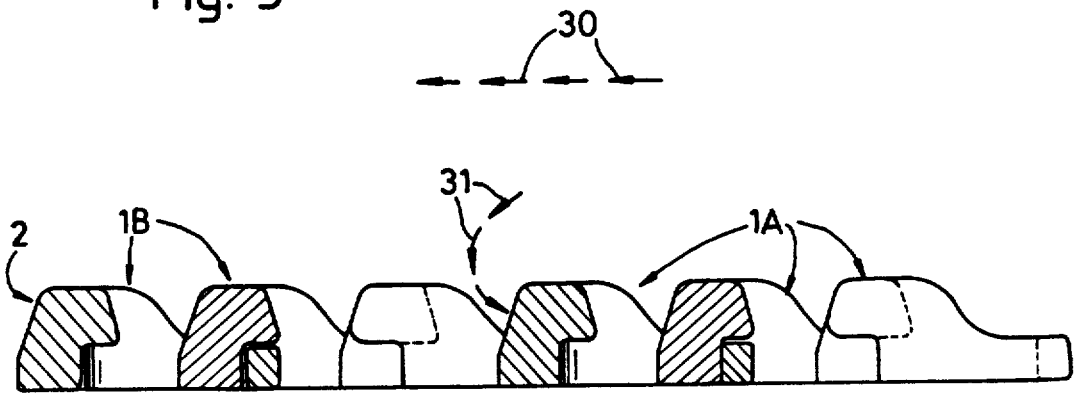
FIG. 4 indicates the rack of FIGS. 2 and 3, in use.
Figure 5:
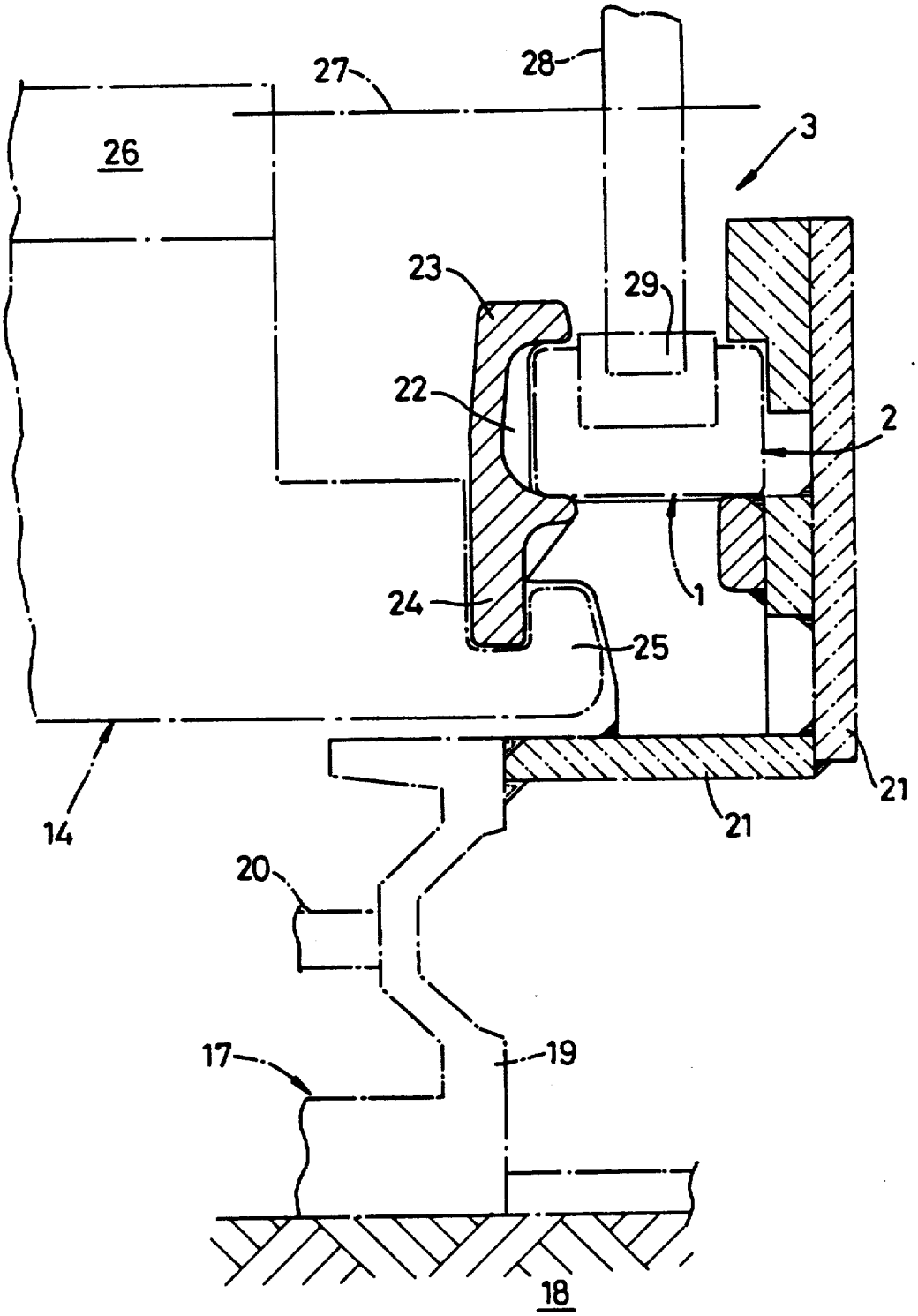
FIG. 5 is a transverse section through mine equipment in accordance with the third aspect.

In FIG. 1 is illustrated an element 1 adapted to be inter-engaged with a plurality of similar elements to form a rack 2 (FIGS. 2–4) for a mining machine haulage system 3 (FIG. 5).

Each element 1 comprises, at one end 4, a looped end portion 5 including inner and outer arcuate bearing surfaces 6, 7 respectively, the inner bearing surface 6 defining one end of an upwardly open aperture 8, and spaced from that inner bearing surface 6 a downwardly projecting tooth 9 adapted when inter-engaged with the next adjacent element 1 to fill partly the aperture 8 of that next adjacent element 1. The element 1 also has a correspondingly arcuate bearing surface 10 for abutment against the inner aperture bearing surface 6, and the other end of each element comprises a transversely extending bridge 11 having transversely extending and upwardly converging planar faces 12, 13 for engagement, in use, by a tooth (not show n) of a driven haulage system 3 of an associated mining machine 14 (FIG. 5), dependent upon the direction of haulage. An arcuately concave bearing surface 16 is also provided at opposite sides of each element 1, for abutting engagement with the outer arcuate bearing surface 7 of the looped end portion 5 of the next adjacent element 1.

As illustrated in FIG. 5, the mining machine haulage system 3 comprising an armoured face conveyor 17 seated on a mine floor 18 and comprising a goaf-side sigma section side wall 19 connected by a deck plate 20 to a similar but face side sigma section sidewall (not shown). Furnishings 21 are welded and/or bolted to the sidewall 19 and define a pocket 22 in which the rack 2 is trapped, a trapping rail 23 having a lower flange 24 slidably engaged by a trapping shoe 25 of the mining machine 14 having a haulage unit 26 with a drive axis 27 for a drive pinion 28 a tooth 29 being shown in engagment with the rack 2 and specifically with one face 12 or 13 of the bridge 11.

FIG. 4 illustrates that, for a mining machine 14 hauling itself in the direction of arrows 30, and sprocket wheel engagement with the rack being at the zone indicated by arrows 31, elements 1A behind the sprocket wheel are in an abutting, compressive relationship, while elements 1B adhead of the sprocket wheel are in tension.

What I claim is:

1. An element, adapted to be inter-engaged end-to-end with a plurality of similar, adjacent elements to form a rack for a mining machine haulage system, each element comprising, at one end, a looped end portion including inner and outer arcuate bearing surfaces, said inner bearing surface defining one end of an upwardly open, elongate aperture, a downwardly projecting tooth spaced from said inner bearing surface and adapted to fill partly said aperture of the next adjacent inter-engaged element with the non-filled part of said aperture remaining open, a correspondingly arcuate and convex bearing surface provided on said tooth for abutment against said inner arcuate bearing surface of said adjacent element, a transversely extending bridge provided at the other end of said element, transversely extending and upwardly converging, planar drive faces provided on said bridge for engagement, in use, from above by a tooth of a driven haulage system of an associated mining machine, dependent upon the direction of haulage, and an arcuately concave bearing surface also provided at each lateral side of said element, for abutting engagement with two laterally spaced contact areas of said outer arcuate bearing surface of said looped end portion of said next adjacent element.

2. An element as claimed in claim 1, wherein said element is produced as a steel forging.

3. A haulage rack for a mining machine, wherein said haulage rack is assembled from a plurality of elements, each of said elements being adapted to be inter-engaged end-to-end with a plurality of similar, adjacent elements to form a rack for a mining machine haulage system, each element comprising, at one end, a looped end portion including inner and outer arcuate bearing surfaces, said inner bearing surface defining one end of an upwardly open, elongate aperture, a downwardly projecting tooth spaced from said inner bearing surface and adapted to fill partly said aperture of the next adjacent inter-engaged element with the non-filled part of said aperture remaining open, a correspondingly arcuate and convex bearing surface provided on said tooth for abutment against said inner arcuate bearing surface of said adjacent element, a transversely extending bridge provided at the other end of said element, transversely extending and upwardly converging, planar drive faces provided on said bridge for engagement, in use, from above by a tooth of a driven haulage system of an associated mining machine, dependent upon the direction of haulage, and an arcuately concave bearing surface also provided at each lateral sides of said element, for abutting engagement with two laterally spaced contact areas of said outer arcuate bearing surface of said looped end portion of said next adjacent element.

4. A haulage rack as claimed in claim 3, wherein a respective one of said planar drive faces provided on the respective bridge of each of said respective adjacent rack elements cooperate to define opposing surfaces of a cavity structure for receiving said tooth of said mining machine haulage system whereby said cavity structure is formed by cooperation of said adjacent rack elements.

5. Mine equipment in the form of a mining machine haulage system, comprising an armoured face conveyor, a rack assembled from a plurality of elements, each of said elements being adapted to be inter-engaged end-to-end with a plurality of similar, adjacent elements to form a rack for a mining machine haulage system, each element comprising, at one end, a looped end portion including inner and outer arcuate bearing surfaces, said inner bearing surface defining one end of an upwardly open, elongate aperture, a downwardly projecting tooth spaced from said inner bearing surface and adapted to fill partly said aperture of the next adjacent inter-engaged element with the non-filled part of said aperture remaining open, a correspondingly arcuate and convex bearing surface provided on said tooth for abutment against said inner arcuate bearing surface of said adjacent element, a transversely extending bridge provided at the other end of said element, transversely extending and upwardly converging, planar drive faces provided on said bridge for engagement, in use, from above by a tooth of a driven haulage system of an associated mining machine, dependent upon the direction of haulage, and an arcuately concave bearing surface also provided at each lateral sides of said element, for abutting engagement with two laterally spaced contact areas of said outer arcuate bearing surface of said looped end portion of said next adjacent element, said rack being captivated to one side of said conveyor, a mining machine mounted on and guided by said conveyor, at least one haulage sprocket forming part of said mining machine, with teeth of said sprocket being adapted to engage progressively said planar faces of said successive bridges during haulage of said mining machine along said conveyor.

* * * * *